US011752503B2

(12) United States Patent
Sepulveda et al.

(10) Patent No.: US 11,752,503 B2
(45) Date of Patent: Sep. 12, 2023

(54) ANTI-PLUGGING DISCHARGE GRATES

(71) Applicant: POLYCORP LTD., Elora (CA)

(72) Inventors: Jaime E. Sepulveda, Santiago (CL); Pramod Kumar, Waterloo (CA)

(73) Assignee: Polycorp Ltd., Elora (CA)

( * ) Notice: Subject to any disclaimer, the term of this patent is extended or adjusted under 35 U.S.C. 154(b) by 83 days.

(21) Appl. No.: 17/334,067

(22) Filed: May 28, 2021

(65) Prior Publication Data

US 2021/0370310 A1 Dec. 2, 2021

Related U.S. Application Data

(60) Provisional application No. 63/032,017, filed on May 29, 2020.

(51) Int. Cl.

| | |
|---|---|
| ***B02C 17/18*** | (2006.01) |
| ***B02C 17/04*** | (2006.01) |
| ***B02C 17/10*** | (2006.01) |

(52) U.S. Cl.

CPC ..... *B02C 17/1855* (2013.01); *B02C 17/04* (2013.01); *B02C 17/10* (2013.01)

(58) Field of Classification Search

CPC ..... B02C 17/04; B02C 17/10; B02C 17/183; B02C 17/1835; B02C 17/1825; B02C 17/1855

See application file for complete search history.

(56) References Cited

U.S. PATENT DOCUMENTS

| | | | | |
|---|---|---|---|---|
| 1,606,545 | A * | 11/1926 | Van Saun | B02C 17/06 209/397 |
| 8,308,906 | B2 | 11/2012 | Page et al. | |
| 8,360,350 | B2 | 1/2013 | Mepham et al. | |
| 9,289,775 | B2 | 3/2016 | Mepham et al. | |

(Continued)

FOREIGN PATENT DOCUMENTS

WO WO 2016/044936 3/2016

OTHER PUBLICATIONS

Sepúlveda, "A Conceptual Model for SAG Discharge Grate Blockage (Pegging)" (with English translation), Conminutek, Apr. 3-4, 2014, 44 pages.

(Continued)

*Primary Examiner* — Matthew Katcoff
*Assistant Examiner* — Mohammed S. Alawadi
(74) *Attorney, Agent, or Firm* — Sheridan Ross P.C.

(57) ABSTRACT

A discharge grate assembly in a discharge end wall system in a mill shell of a grinding mill. The mill shell defines a mill shell chamber in which a charge including grinding balls and ore-bearing rocks is positioned. The mill shell is rotatable about a central axis thereof for comminution of the ore-bearing rocks to form the grinding balls into worn grinding balls and to produce a slurry including liquid and worn rock pieces from the ore-bearing rocks. The discharge grate assembly includes a body with elongate apertures therein, each aperture extending between a first end thereof and a wider second end thereof. The first and second ends of the aperture are partially defined by respective first and second end walls that are at least partially rectilinear, for impeding the worn grinding balls and the worn rock pieces from lodging in the aperture.

22 Claims, 12 Drawing Sheets

(56) References Cited

U.S. PATENT DOCUMENTS

| | | | | |
|---|---|---|---|---|
| 2011/0068207 | A1* | 3/2011 | Mepham | B02C 17/1855 241/285.1 |
| 2017/0014831 | A1 | 1/2017 | Mepham et al. | |
| 2019/0388900 | A1 | 12/2019 | McPhee et al. | |

OTHER PUBLICATIONS

Sepúlveda, "A Conceptual Model for SAG Discharge Grate Blockage (Pegging)" (with English translation), Conminutek, Apr. 3-4, 2014, 34 pages.

* cited by examiner

ANTI-PLUGGING DISCHARGE GRATES

CROSS-REFERENCE TO RELATED APPLICATION

This application claims the benefit of U.S. Provisional Patent Application No. 63/032,017, filed May 29, 2020, the entirety of which is hereby incorporated herein by reference.

FIELD OF THE INVENTION

The present invention is a discharge grate assembly formed to impede worn rock pieces from lodging in the apertures therein.

BACKGROUND OF THE INVENTION

As is well known in the art, grinding media (e.g., grinding balls) that have become worn over time sometimes tend to become jammed in apertures in the discharge grates that are located at a discharge end of a mill shell chamber in a grinding mill. This can occur when the grinding balls have become sufficiently worn that they are small enough to partly fit into the apertures in the discharge grates, to partially block the apertures.

Typically, at the same time as the grinding media are becoming worn, and therefore smaller, the discharge grates are also subjected to wear, with the result that the apertures in the discharge grates gradually become larger over time. Accordingly, the risk that a discharge grate may become plugged (in whole or in part) increases over the operating life of the discharge grate.

Once the worn grinding ball is small enough that it can at least partly fit into the apertures, the worn grinding ball may stay positioned in the aperture. In this situation, the worn grinding ball tends to be pressed further into the apertures by the charge in the mill shell chamber hammering against the worn grinding ball positioned in the aperture, as the grinding mill shell rotates about its axis. As is well known in the art, most discharge grates are positioned at an obtuse angle relative to the horizontal. The worn grinding ball that stays positioned in the aperture is subjected to very harsh hammering conditions, pushing the worn grinding media into the aperture so that it becomes trapped in the aperture of the discharge grate. However, it is believed that not all of the worn grinding balls that are positioned in the aperture stay in the aperture.

FIG. 1 is a schematic illustration of a worn grinding ball 10 that is lodged in an aperture 12' in a discharge grate 14 that has also become worn, over time. As is well known in the art, the discharge grate 14 is located at a discharge end of a rotatable mill shell, in which the mill shell chamber is defined. The worn grinding ball was included in a charge (not shown in FIG. 1) located in the mill shell chamber, and the worn grinding ball is carried to the aperture 12' by slurry exiting the mill shell chamber. The slurry includes a liquid (e.g., water) and fines, including relatively small rock pieces.

Although the worn grinding ball may have any shape (and may be worn down to a somewhat irregular shape), for clarity of illustration, the worn grinding ball 10 as illustrated has a generally round exterior. The discharge grate 14 is formed and installed so that slurry (not shown in FIG. 1) will pass through the aperture in the direction indicated by arrow "A", into a pulp chamber (not shown in FIG. 1).

The discharge grate 14, as originally installed, had exterior surfaces 15, 16 and interior surfaces 17, 18 that had previously defined an original aperture therebetween that was smaller than the current aperture 12'. The original aperture was sized so that the slurry passing therethrough was screened to prevent rock pieces or worn grinding balls larger than the aperture from passing through the original aperture. As can be seen in FIG. 1, the worn discharge grate 14 has worn exterior surfaces 15', 16' and worn interior surfaces 17', 18' that define the aperture 12'.

Because the interior surfaces 17', 18' and the exterior surfaces 15', 16' are worn, the aperture 12' that is defined thereby is larger than the original aperture that had been defined by the original interior surfaces 17, 18 and the original exterior surfaces 15, 16. In addition, and as can be seen in FIG. 1, due to both the exterior and the interior surfaces becoming worn, the worn exterior and interior surfaces tend to form rounded, opposing surfaces between which the worn grinding ball 10 may tend to become caught.

The worn grinding ball 10 has a center of gravity identified in FIG. 1 by reference numeral 20. As illustrated in FIG. 1, the worn grinding ball 10 is lodged in the aperture 12' when the center of gravity 20 of the worn grinding ball 10 is positioned below a plane 22 that is defined by the worn exterior surfaces 15', 16'. In the example illustrated in FIG. 1, the worn ball 10 engages the worn interior surfaces 17', 18' at points 24, 25 defined by a second plane identified in FIG. 1 by reference numeral 26.

It will be understood that the discharge grate 14 is positioned in the mill shell so that the original exterior surface 15 is located at an obtuse angle, e.g., approximately 105° from the horizontal. Accordingly, as illustrated in FIG. 1, the region above the exterior surface 15 is the mill shell chamber, identified by reference character "MSC".

When a worn grinding ball is only partially located in the aperture, and its center of gravity is above the plane 22 as illustrated in FIG. 1 (i.e., when the center of gravity is located in the mill shell chamber), the worn ball is easily dislodged from the aperture, i.e., by the charge that is rotated in the mill shell chamber as the mill shell rotates.

As is well known in the art, the discharge grate 14 typically is made of a material that is not as hard as the material of the grinding balls. Accordingly, once a worn ball becomes lodged in an aperture between the worn interior surfaces defining the aperture (i.e., when the center of gravity is in the aperture 12'), and when the worn ball has been urged into the aperture by the impacts of the charge thereon as the mill shell rotates, the discharge grate 14 may suffer some plastic deformation, where the discharge grate 14 is engaged by the worn ball 10. In effect, the worn grinding media 10 may become embedded, to an extent, in the worn surfaces of the worn discharge grate.

As is well known in the art, rock pieces that are sufficiently small to become lodged in the aperture may also become jammed there.

The result is that a worn grinding ball that becomes lodged in an aperture (i.e., with its center of gravity in the aperture 12') tends to stay lodged in the aperture. In this situation, an individual worn grinding ball partially blocks slurry from passing through the aperture to the pulp chamber in communication with the aperture. A number of worn balls may become lodged along the length of an aperture, so that most of the potential flow of the slurry through that aperture may be blocked. Over time, a sufficient number of apertures of a sufficient number of discharge grates may become partially blocked, to the extent that the grinding capacity of the mill may become significantly limited thereby.

SUMMARY OF THE INVENTION

For the foregoing reasons, there is a need for an anti-plugging discharge grate that overcomes or mitigates one or more of the defects or disadvantages of the prior art.

In its broad aspect, the invention provides a discharge grate assembly having a body with a number of elongate apertures therein. Each aperture extends between respective first and second ends thereof. The first end has a predetermined first end width, and the second has a predetermined second end width that is larger than the first end width.

BRIEF DESCRIPTION OF THE DRAWINGS

The invention will be better understood with reference to the attached drawings, in which.

DETAILED DESCRIPTION

Figure 1:
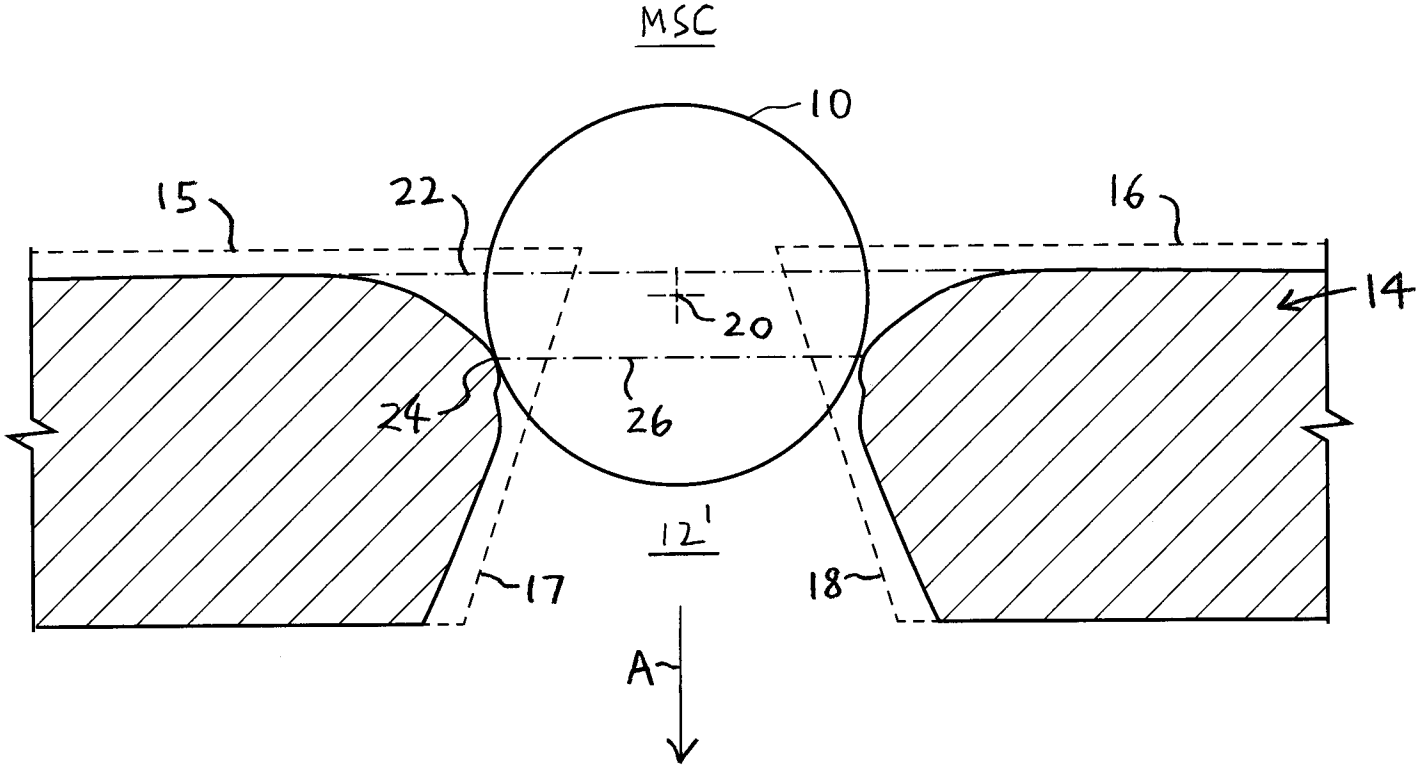
FIG. 1 (PRIOR ART)
FIG. 1 (also described previously) is a schematic illustration showing the extent to which a discharge grate of the prior art may change, after being subjected to wear, and also showing a worn grinding ball lodged in an aperture thereof.

In the attached drawings, like reference numerals designate corresponding elements throughout. In particular, to simplify the description, the reference numerals used in FIG. 1 are used again in connection with the description of the invention hereinafter, except that each such reference numeral is raised by 100 (or by whole number multiples thereof, as the case may be), where the elements correspond to elements illustrated in FIG. 1. Reference is made to FIGS. 2A-6D to describe an embodiment of a grinding mill in accordance with the invention indicated generally by the numeral 130.

Figure 2A:
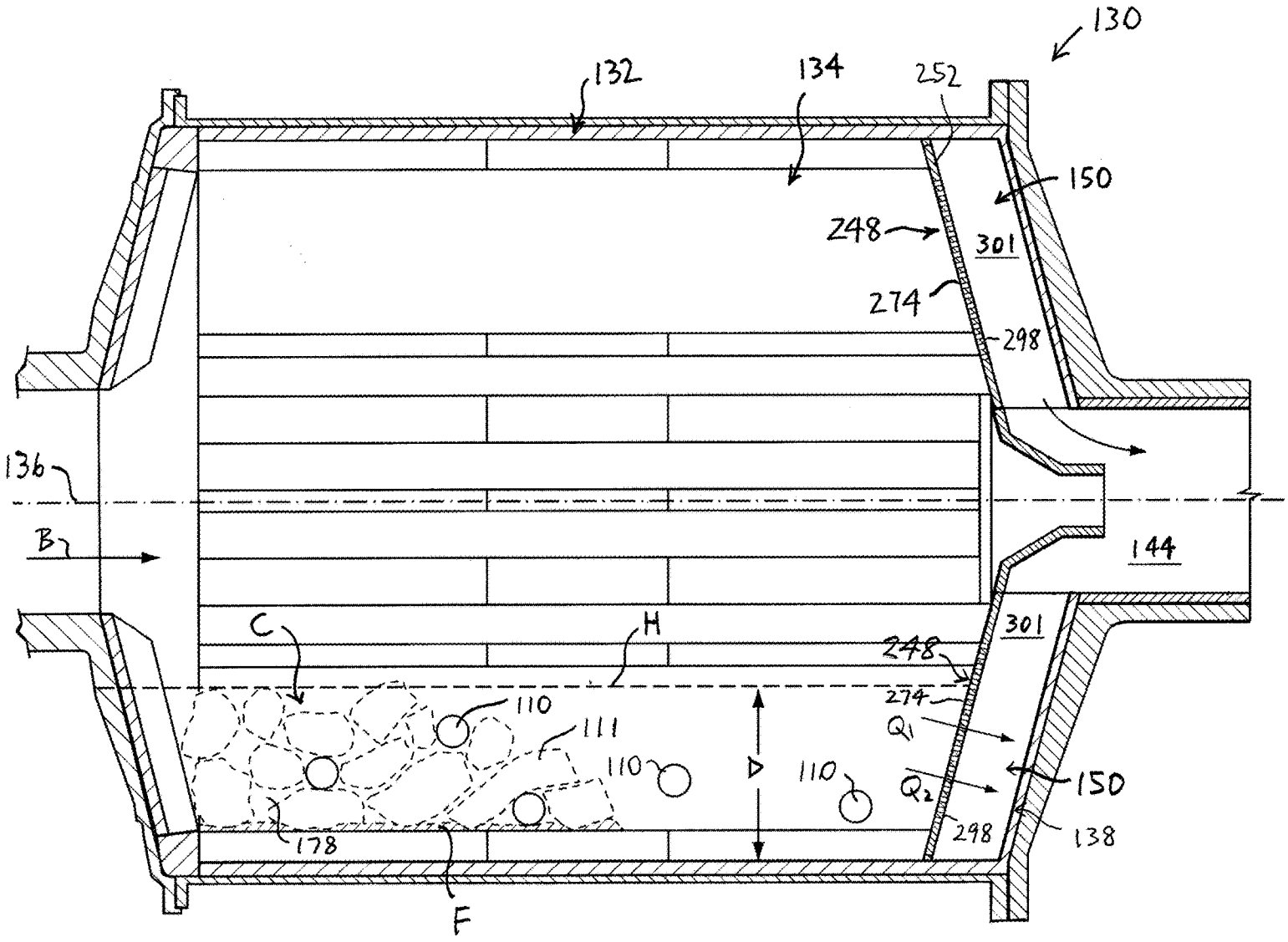
FIG. 2A is a longitudinal cross-section of an embodiment of a grinding mill of the invention including an embodiment of the discharge grate assembly of the invention, drawn at a smaller scale.
Figure 2B:
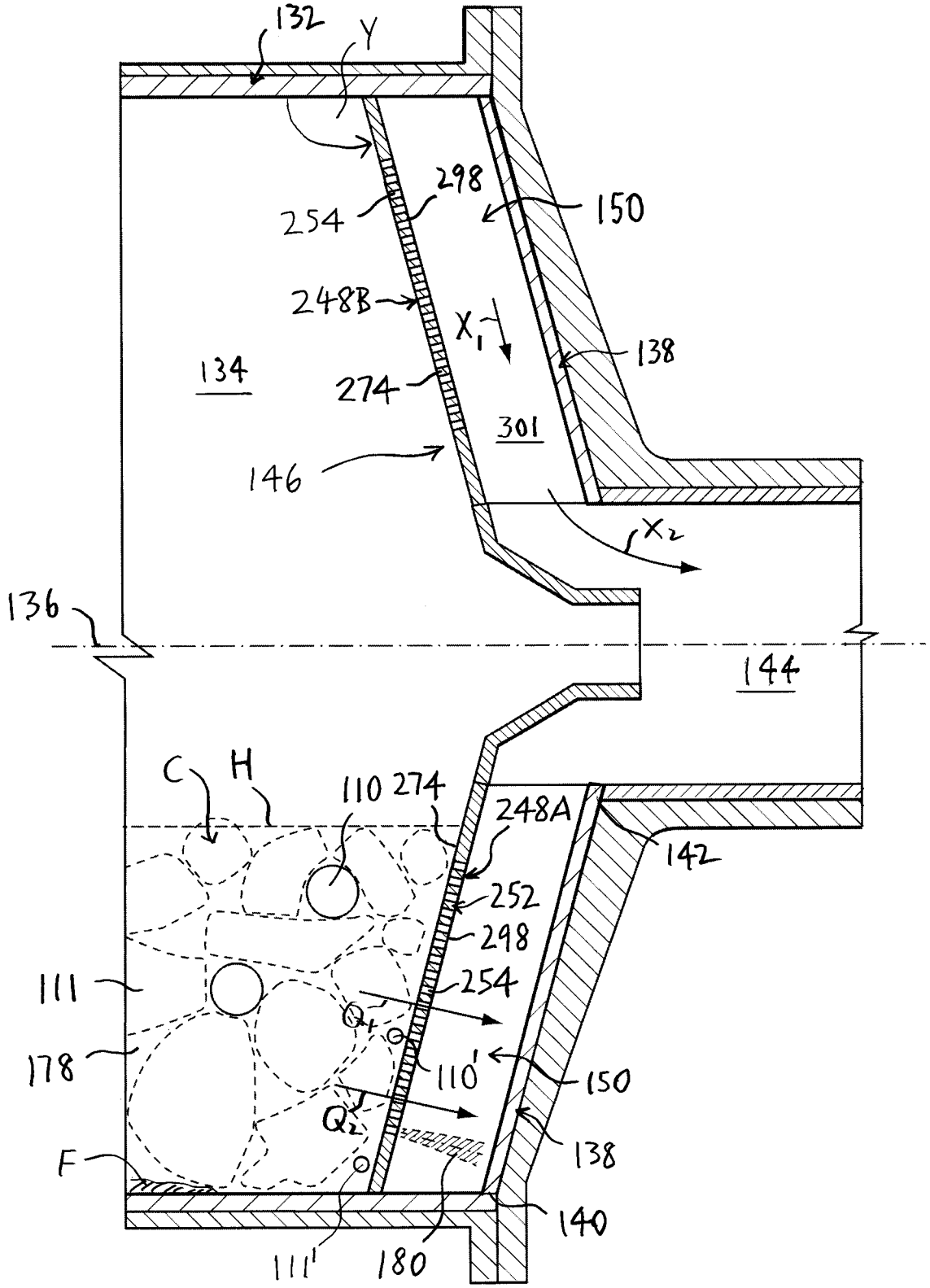
FIG. 2B is another cross-section of the grinding mill of FIG. 1, drawn at a larger scale.

As can be seen in FIGS. 2A and 2B, in one embodiment, the grinding mill 130 includes a shell 132 defining a mill shell chamber 134 therein in which a charge "C" including grinding balls 110 and ore-bearing rocks 111 is positioned. The shell 132 is rotatable in a predetermined direction about a central axis 136 thereof for comminution of the ore-bearing rocks 111 to form the grinding balls into worn grinding balls 110', and to produce a mixture 180 including a fluid and fines "F" from the ore-bearing rocks (FIG. 2B). As will be described, the mixture 180 may also carry relatively small rock pieces 111'. Those skilled in the art would appreciate that the rock pieces 111' are worn rock pieces (i.e., larger in diameter than fines) that are broken or worn off from the ore-bearing rocks 111.

In many grinding mills, the charge includes water, and the fluid in the mixture is water. In these circumstances, the mixture is commonly referred to as "slurry". However, those skilled in the art would appreciate that, alternatively, in "dry" grinding, comminution may be effected in the absence of water. Accordingly, the fluid may be air, or any suitable gas or gases.

As can be seen in FIG. 2A, the charge "C" includes the grinding balls 110 and the ore-bearing rocks 111 positioned in the mill shell chamber 134. It will be understood that only a portion of the charge "C" is illustrated in FIG. 2A, for clarity of illustration. In FIG. 2A, certain of the grinding balls 110 are also shown separately from the ore-bearing rock 111, for clarity. Water 178 in the mill shell chamber 134 is schematically represented in FIGS. 2A and 2B. It will also be understood that the line "H" in FIGS. 2A and 2B indicates the approximate depth "D" of the charge "C", including the water 178.

In one embodiment, the grinding mill 130 preferably includes a discharge end wall 138 attached to the shell 132. As can be seen in FIGS. 2A and 2B, the discharge end wall 138 preferably extends between an outer edge 140 thereof connected to the shell 132 and an inner edge 142 thereof at least partially defining a central opening 144 in the discharge end wall 138.

It is also preferred that the grinding mill 130 includes a discharge end wall system 146. In one embodiment, the discharge end wall system 146 preferably includes a number of discharge grate assemblies 248 and a number of pulp chambers 150 located between the respective discharge grate assemblies 248 and the discharge end wall 138. As will be described, the pulp chambers 150 are for directing the slurry (or mixture) 180 received therein toward the central opening 144, to exit the grinding mill 130 therethrough. Each of the discharge grate assemblies 248 is positioned to screen the slurry (or mixture) 180 flowing from the mill shell chamber 134 into each said pulp chamber 150 respectively, as the shell 132 rotates about the central axis 136.

It will be understood that each of the discharge grate assemblies 248 is rotatable with the shell 132 about the central axis 136 between a lowered condition, in which the slurry (or mixture) is flowable through at least part of the discharge grate assembly 248 into the pulp chamber 150 adjacent thereto respectively, and a raised condition, in which the discharge grate assembly 248 is positioned above the charge "C".

As an example, in FIG. 2B, the discharge grate assembly identified by reference character 248A is in the lowered condition, and the discharge grate assembly identified by reference character 248B is in the raised condition. The slurry (or mixture) 180 flows into the pulp chamber 150 under the influence of gravity, and the slurry 180 is schematically represented by arrows "$Q_1$", "$Q_2$" in FIGS. 2A and 2B.

When a discharge grate assembly is in the raised condition, the slurry (or mixture) in the pulp chamber adjacent to that discharge grate assembly flows out of the pulp chamber 150 under the influence of gravity and exits the grinding mill via the central opening 144. In FIG. 2B, the slurry (or mixture) flowing out of the raised pulp chamber is schematically represented by arrows "$X_1$", "$X_2$".

Figure 6A:
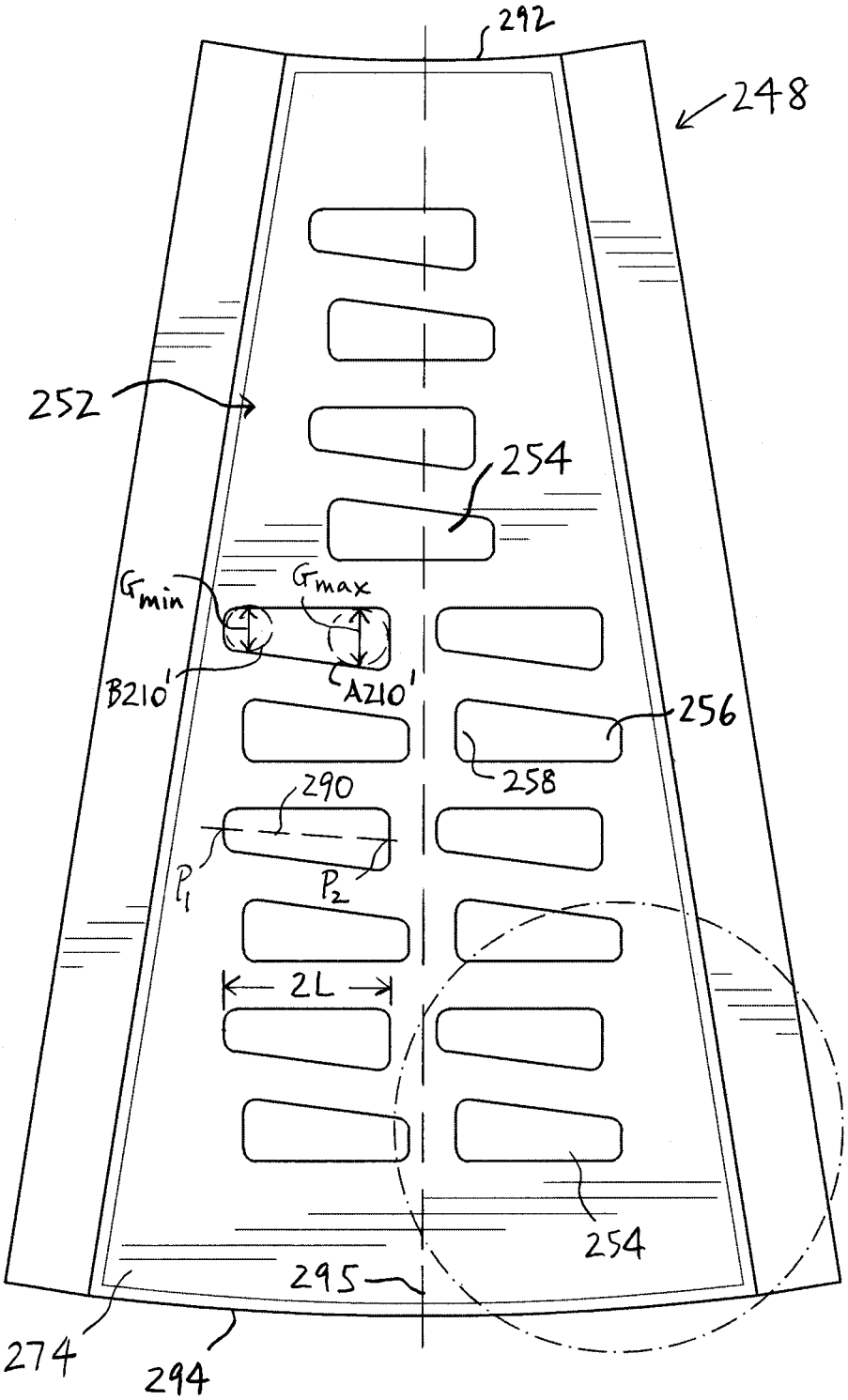
FIG. 6A is a plan view of the discharge grate assembly of FIGS. 2A, 2B, and 4B.
Figure 6B:
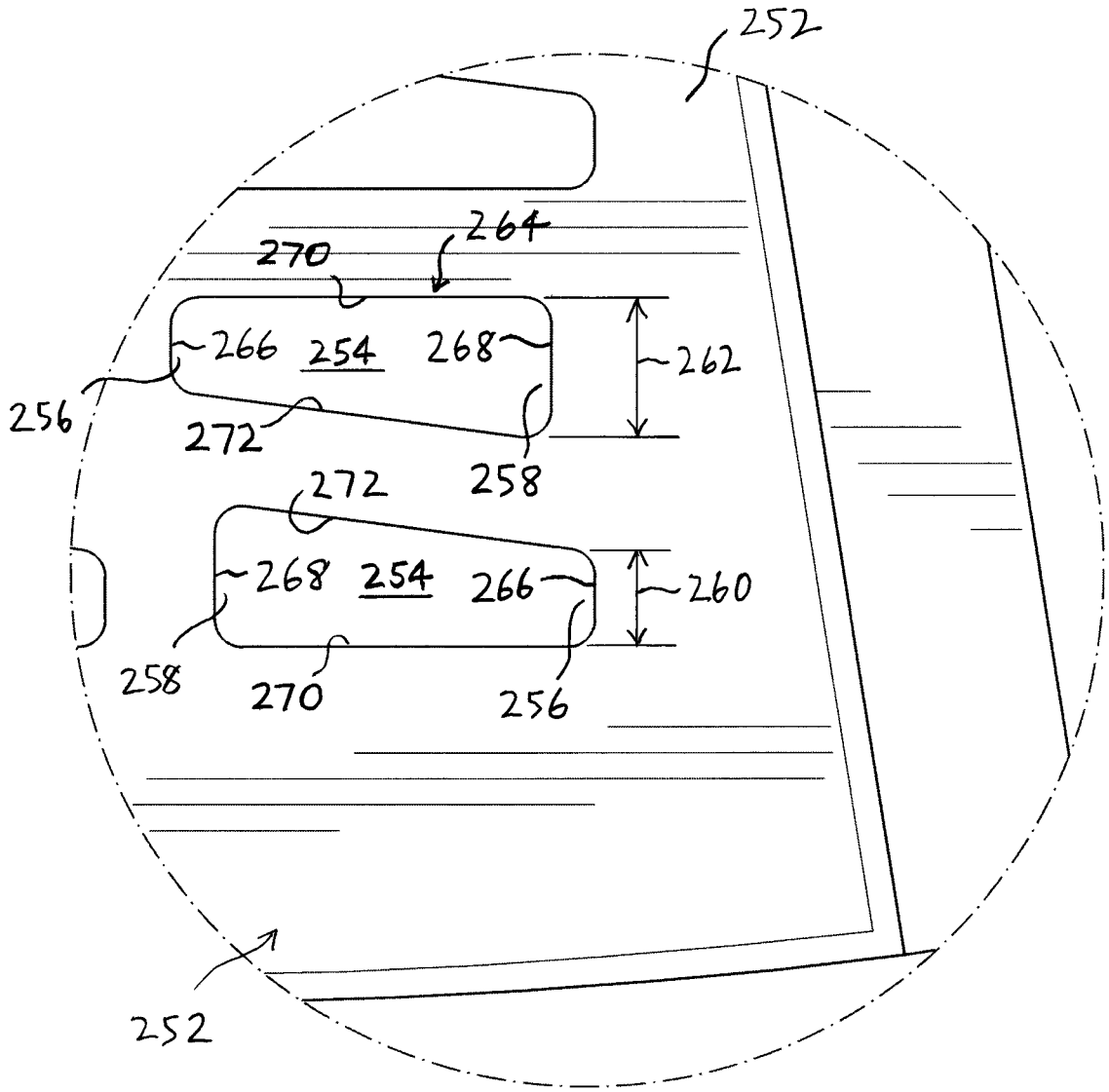
FIG. 6B is a portion of the discharge grate assembly of FIG. 6A, drawn at a larger scale.

In one embodiment, the discharge grate assembly 248 preferably includes a body 252 having a number of elongate apertures 254 therein that are formed to screen the slurry (or mixture) flowing therethrough from the mill shell chamber 134 into the pulp chamber 150 therefor (FIGS. 2A, 2B, 6A-6D). Preferably, and as will be described, the elongate aperture 254 extends between respective first and second ends 256, 258 thereof (FIGS. 4B, 6A-6D). As can be seen in FIG. 6B, in one embodiment, the first end 256 preferably has a predetermined first end width 260 and the second end 258 preferably has a predetermined second end width 262 that is larger than the first end width 260. As will be described, due to the shape of the elongate aperture 254, the discharge grate assembly 248 is self-cleaning.

The elongate aperture 254 is defined by aperture walls 264 that are formed in the body 252. In one embodiment, the aperture walls 264 preferably include first and second end walls 266, 268 that are at least partially rectilinear, and partially define the first and second ends 256, 258 respectively. As will also be described, the first and second ends 256, 258 are formed to impede the worn grinding balls 110' and the worn rock pieces 111' in the slurry 180 from lodging in the aperture.

It will be understood that the grinding balls 110 that are illustrated in FIGS. 2A and 2B have been subjected to minimal wear. Those skilled in the art would appreciate that, as noted above, during comminution of the ore-bearing rocks 111, the grinding balls 110 are also subjected to significant wear. For clarity of illustration, the grinding balls that are worn to a relatively small diameter are identified by reference character 110' (FIG. 2B), and the rock pieces worn or broken from the ore-bearing rocks 111 that are small enough to be carried in the slurry 180 are identified by reference character 111' (FIG. 2B). It will also be understood that the sizes of the worn grinding ball 110' and the worn rock piece 111' that are illustrated in FIG. 2B are exaggerated, for clarity of illustration.

For the purposes hereof, a worn grinding ball 110' or a worn rock piece 111' is considered to be lodged in the aperture 254 if the center of gravity thereof is in the aperture 254. If a center of gravity 184 of the worn grinding ball 110' or the worn rock piece 111' is not in the aperture, but instead is in the mill shell chamber 134, then the worn grinding ball 110' or the worn rock piece 111' (as the case may be) is not lodged in the aperture 254.

As will be described, if the center of gravity 184 of a particular worn rock piece 111' or worn grinding ball 110' is located in the aperture 254, then that worn rock piece 111' or worn grinding ball 110' is "lodged" therein, and is likely to stay lodged (i.e., jammed) in the aperture 254. Conversely, if the center of gravity 184 of a particular worn rock piece 111' or worn grinding ball 110' is outside the aperture 254, i.e., in the mill shell chamber 134, then the worn rock piece 111' or worn grinding ball 110' is not positioned sufficiently far enough in the aperture 254 to remain in the aperture (i.e., the worn rock piece 111' or the worn grinding ball 110' is not "lodged" in the aperture), and the worn rock piece or worn grinding ball will not remain partly in the aperture, but will fully return to the mill shell chamber 134.

As can be seen in FIG. 6B, in one embodiment, the aperture walls 264 preferably also include first and second side walls 270, 272 that respectively extend between the first and second end walls 266, 268. It is also preferred that the first and second side walls 270, 272 are rectilinear. Because the second end is wider than the first end, the aperture 254 widens from the first end toward the second end, which provides the grate 248 with its self-cleaning characteristic.

Figure 4A:
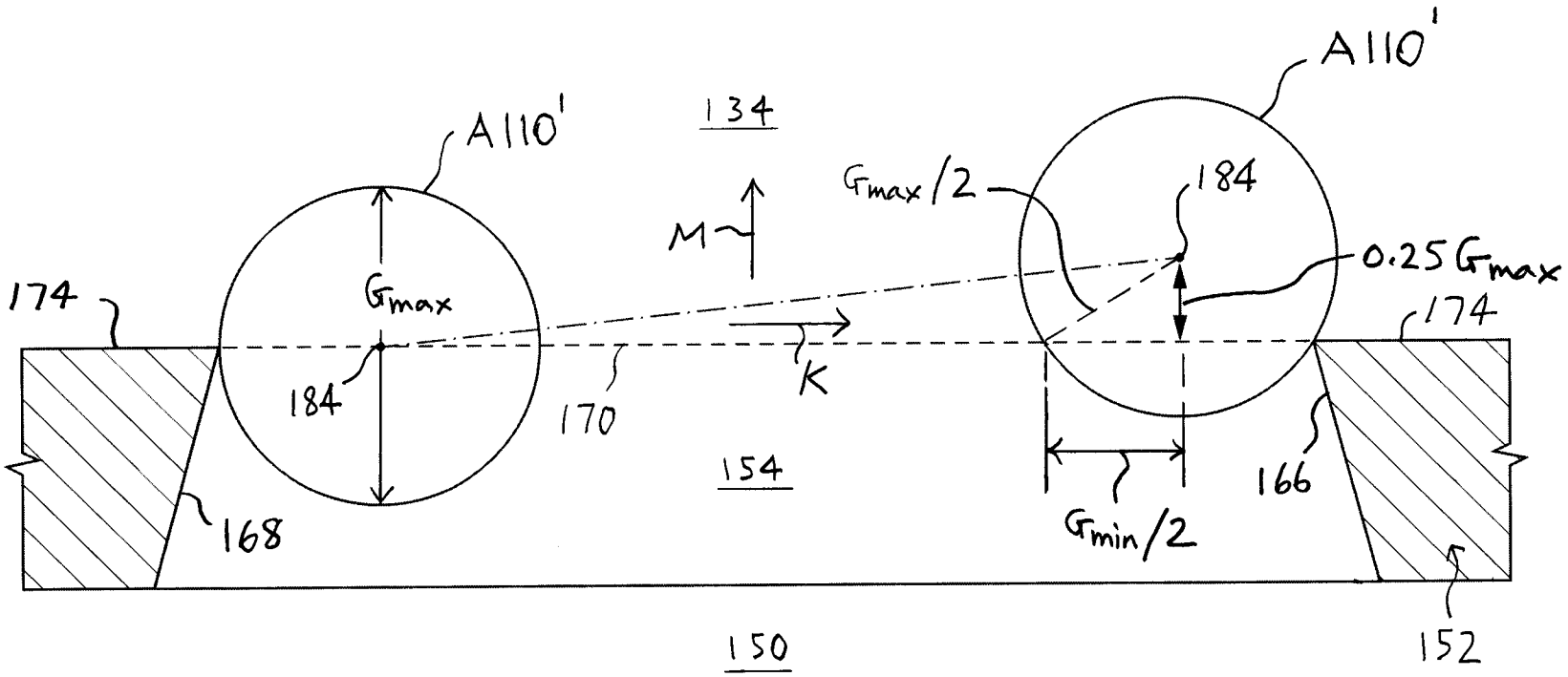
FIG. 4A is a longitudinal cross-section of the discharge grate assembly of FIG. 3 taken along an aperture therein.
Figure 4B:
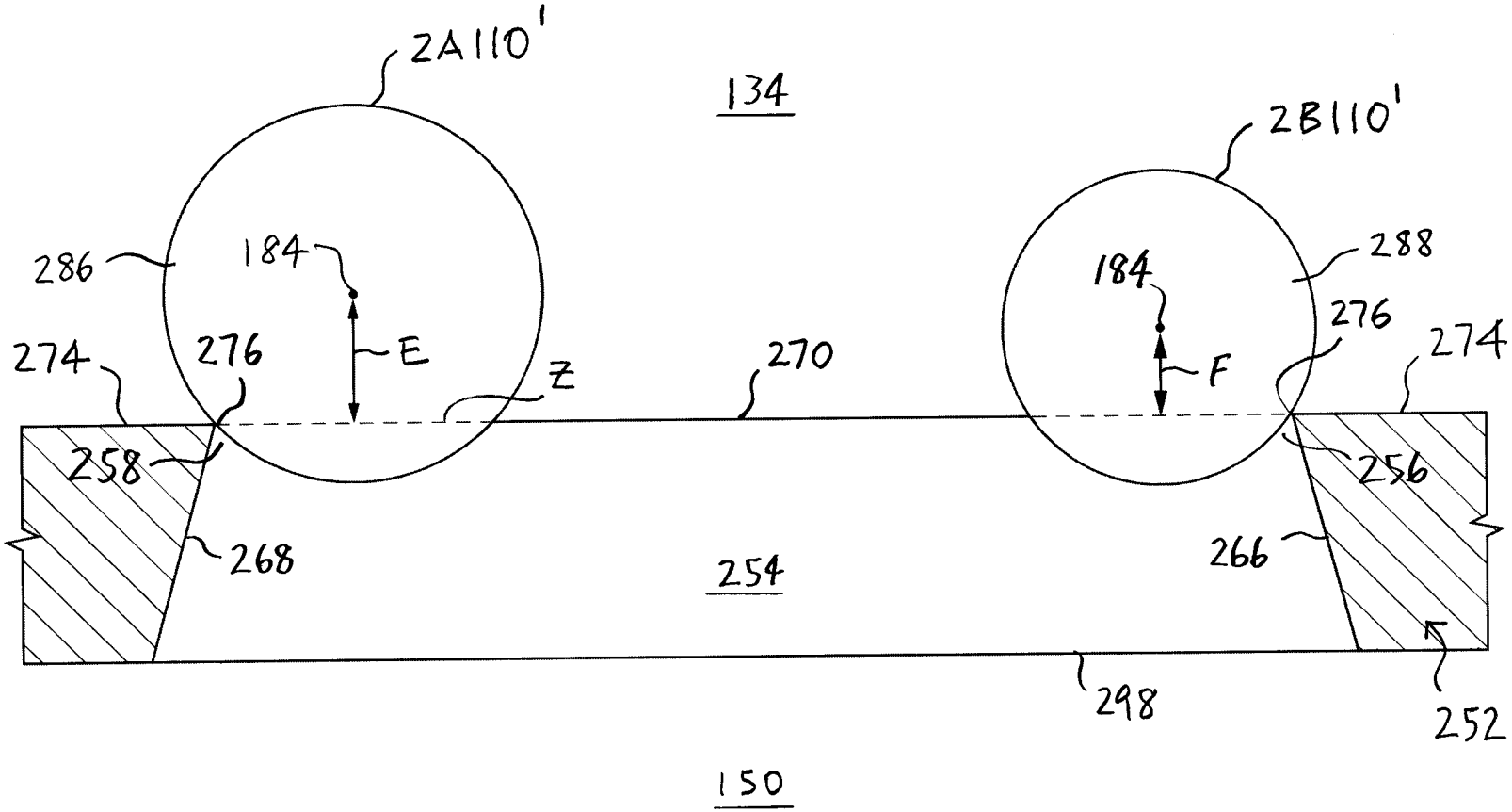
FIG. 4B is a longitudinal section of the discharge grate assembly of FIGS. 2A and 2B taken along an aperture therein.

In one embodiment, the body 252 includes an at least partially planar front side 274 that faces the mill shell chamber 134 (FIGS. 2A, 2B, 4B). Preferably, each of the aperture walls 264 defines an aperture wall edge 276 thereof at which the aperture wall 264 intersects the front side 274 of the body 252 (FIG. 4B). For the purposes hereof, when the center of gravity 184 of the worn grinding ball 110' or the worn rock piece 111' (as the case may be) is aligned with the front side 274, the worn grinding ball 110' or the worn rock piece 111' is not considered to be lodged in the aperture 254, but instead is considered to be located in the mill shell chamber 134.

As can be seen in FIG. 4B, in one embodiment, the aperture walls 264 preferably are formed in a non-orthogonal position relative to the front side 274. It is preferred that the aperture walls 264 are formed to define an acute angle Θ between the aperture wall 264 and the front side 274. It is believed that this configuration, in which the aperture walls are spaced further apart from each other with increased distance thereof from the front side 274, is advantageous because the risk of worn grinding balls or rock pieces (as the case may be) lodging in the aperture 248 is greatest only at the location where the aperture walls intersect the front side 274.

It will be understood that the discharge grate assembly 248 includes fasteners and other ancillary elements (not shown) that are used to locate the discharge grate body 252 in a preselected location thereof in the discharge end wall system 146 (FIGS. 2A, 2B).

Those skilled in the art would appreciate that the ore-bearing rocks 111 may be a variety of sizes. The charge "C" includes fines "F". In the charge, the fines "F" are generally located in interstices between the ore-bearing rocks 111, and between the rocks 111 and the shell 132, however, for clarity of illustration, the fines "F" in the charge that are illustrated in FIG. 2A are located on the mill shell 132.

For the purposes hereof, the terms "ore-bearing rocks" and "rocks" are deemed to include any materials (e.g., rocks or agglomerations of any materials) that are subjected to comminution in the grinding mill, to produce smaller diameter materials (e.g., rocks and worn rock pieces, or pieces of agglomerated materials) that are screened by discharge grate assemblies to limit the materials passing to a preselected size distribution. For example, agglomerated materials such as cement clinker may be considered to be "rocks" for the purposes hereof. Similarly, for the purposes hereof, "rock pieces" are considered to be pieces of the comminuted materials (e.g., agglomerations, or ore-bearing rocks) that have been broken off or worn off such materials by the comminution. As noted above, the materials that are comminuted may be subjected to wet or dry grinding.

Those skilled in the art would also appreciate that the comminution may be effected in the absence of grinding balls, or with grinding balls or other grinding media included in the charge.

It will also be understood that, although the ore-bearing rocks 111 are intended to include ore, the ore-bearing rocks may in practice include some rocks that are waste, i.e., some of the rocks in the charge may not include any ore, due to variations in quality control and mining practices in the mine supplying the feed for the grinding mill. However, for the purposes hereof, all the rocks inside the mill shell chamber 134 are considered to be ore-bearing rocks. Those skilled in the art would appreciate that the charge and additions thereto are directed into the mill 130 at the feed end thereof, as schematically indicated by arrow "B" (FIG. 2A).

It will be understood that the mill shell 132 and the discharge end wall system 146 secured to the mill shell 132 rotate about the central axis 136 at a relatively high rate of speed, e.g., approximately 10 rpm. Those skilled in the art would appreciate that, as a result, any particular discharge grate is in its lowered condition, and then in its raised condition, for only a short period of time in each case. Because of the rotation of the shell, the charge "C" is forced to tumble over itself, and the ore-bearing rocks 111 are consequently subjected to comminution.

As is known in the art, while the mill shell 132 and the discharge end wall system 146 secured to it rotate about the central axis 136, the slurry or mixture 180 (including the fines "F" and worn rock pieces, and the fluid 178 accompanying the fines "F" and worn rock pieces) passes through the apertures 254 of the discharge grate assemblies 248 into the pulp chambers 150 (FIG. 2B). Those skilled in the art would appreciate that the slurry or mixture may only pass through the apertures of any particular discharge grate assembly while that discharge grate assembly is in its lowered condition. As noted above, relatively small rock pieces 111' may also be carried by the slurry or mixture 180 toward the discharge end wall system 146.

Figure 3:
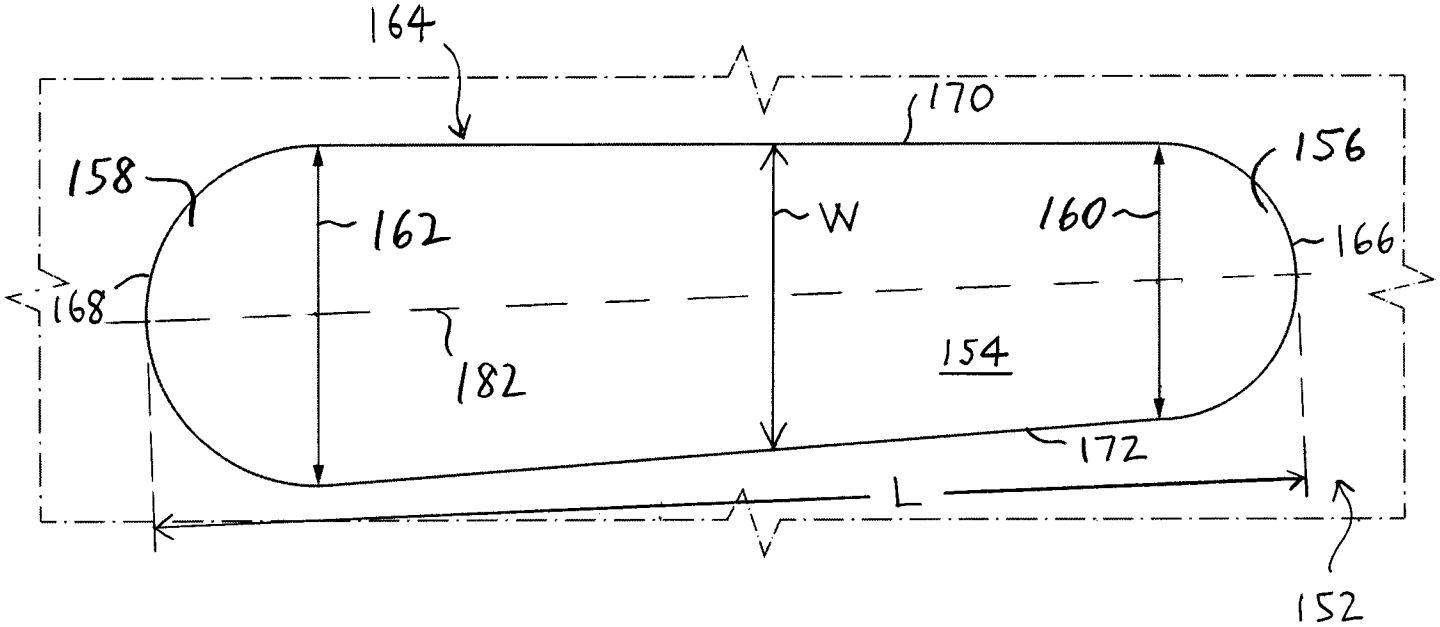
FIG. 3 is a plan view of a portion of another embodiment of a discharge grate assembly of the invention.
Figure 5:
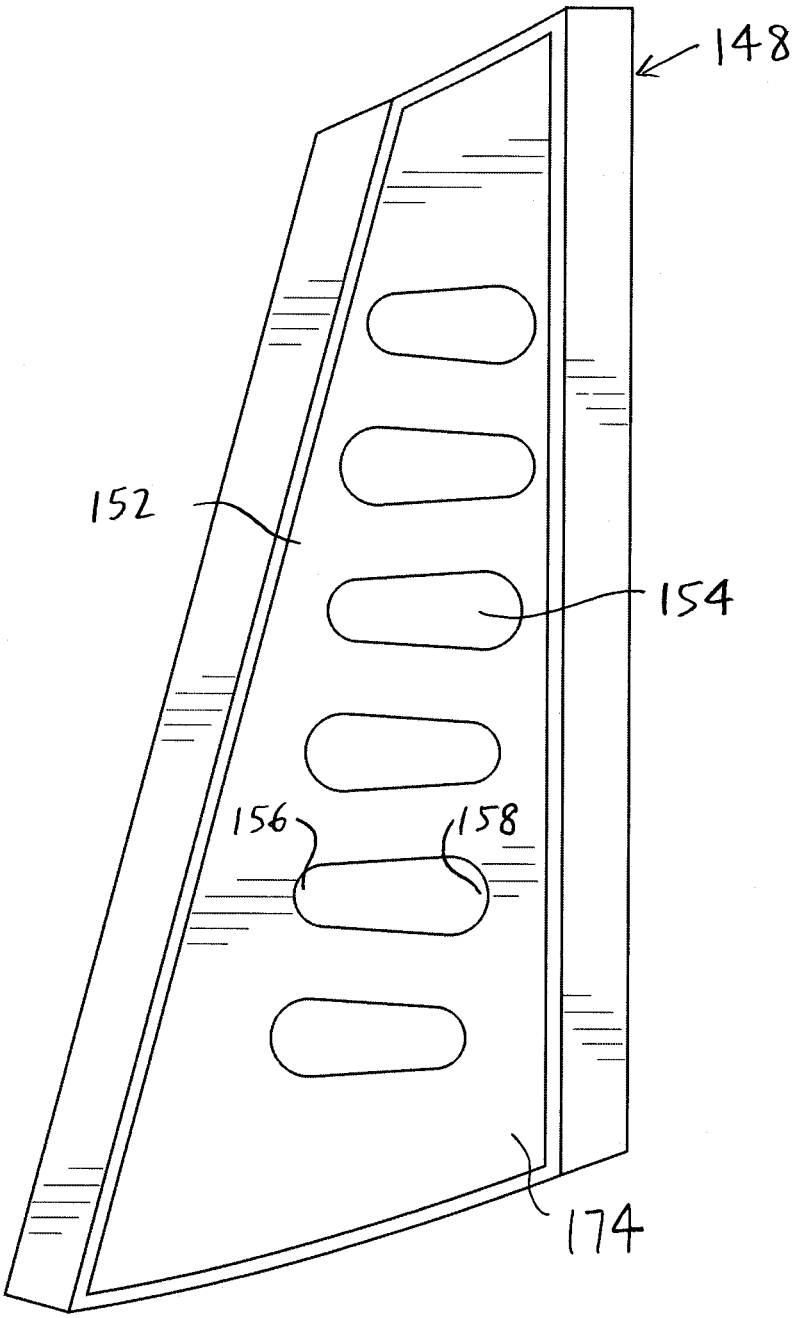
FIG. 5 is a plan view of the discharge grate assembly of FIGS. 3 and 4A, drawn at a smaller scale.

Another embodiment of a discharge grate assembly 148 is illustrated in FIGS. 3, 4A, and 5. As can be seen in FIG. 3, the aperture 154 preferably is elongate, and partially defined by a center line 182. In the example illustrated in FIG. 5, at the first end 156, the width of the aperture 154 is identified by reference character 160, and at the second end 158, the width of the aperture 152 is identified by reference character 162. The width 162 of the aperture 154 at the second end 158 is greater than the width 160 of the aperture 154 at the first end 156.

As a result, the width of the aperture 154 varies along the length "L" of the aperture 154 (FIGS. 3, 5). As will be described, this variation in the width of the aperture (i.e., narrowing along its length, from the second end 158 toward the first end 156) is a feature that provides a "self-cleaning" function of the discharge grate assembly 148. An average width of the aperture 154 is identified by reference character "W" in FIG. 3.

As can be seen in FIG. 3, the first end 156 is partially defined by a first end wall 166 formed in the body 152, and the second end 158 is partially defined by a second end wall 168. In the embodiment of the discharge grate assembly 148 illustrated in FIGS. 3-5, the first and second ends 156,158 are, in plan view, defined by arcs of circles of differing radii respectively. At each end, the end walls 166, 168 join with the side walls 170, 172 that partially define the aperture 154 (FIG. 3). Preferably, the side walls 170, 172 are rectilinear. Because the first and second ends 156, 158 of the aperture 154 are sized differently, the side walls 170, 172 are positioned non-parallel with each other (FIGS. 3, 5). The end walls 166, 168 and the side walls 170, 172 are collectively referred to as the aperture walls 164.

Those skilled in the art would appreciate that, in FIGS. 3-5, the discharge grate assembly 148 is shown prior to it being subjected to wear. After the discharge grate assembly has been subjected to wear, the dimensions of the aperture 154 would be modified (i.e., increased), so that the aperture 154 is gradually expanded as the aperture walls 164 in the body 152 are gradually worn down, over time, due to friction from the slurry passing through the aperture 154. Also, due to wear, the side walls 170, 172 may cease to be rectilinear. Those skilled in the art would also appreciate that the wear to which the body 152 is subjected may not be uniform over the entire body, with the result that the overall shapes of the apertures may become non-uniform, to an extent. However, it is believed that, after the body 152 has become worn, the overall differences between the first and second ends will generally remain, i.e., the second end 158 will still be wider than the first end 156. The side walls also may be only substantially or approximately rectilinear due to wear. As a result, the variation in the width of the aperture over its length is believed to generally remain after wear, although the shape of the aperture may change due to the wear to which the aperture walls 164 in the body 152 are subjected.

It will be understood that the design of the elongate aperture 154 in the discharge grate body 152 typically involves a balance or compromise between different design factors. For instance, although it is desirable to form the aperture 154 so that it is relatively small (i.e., to keep more coarse material in the slurry or mixture from entering into the pulp chambers, and ultimately exiting the grinding mill), it is also desirable to form the aperture 154 so that it is relatively large, in order to have a greater throughput through the grinding mill.

Accordingly, those skilled in the art would appreciate that the average width "W" of the aperture 154 in the discharge grate body 152 are determined by taking the factors outlined above into account to arrive at the width, and the first and second end widths.

In the discharge grate assembly 148 of the invention, one end (i.e., the second end 158) of the aperture 154 preferably is slightly larger than the other end (i.e., the first end 156). That is, the first end width 160 is slightly smaller than the average width "W", and the second end width 162 is slightly larger than the average width "W".

Figure 2C:
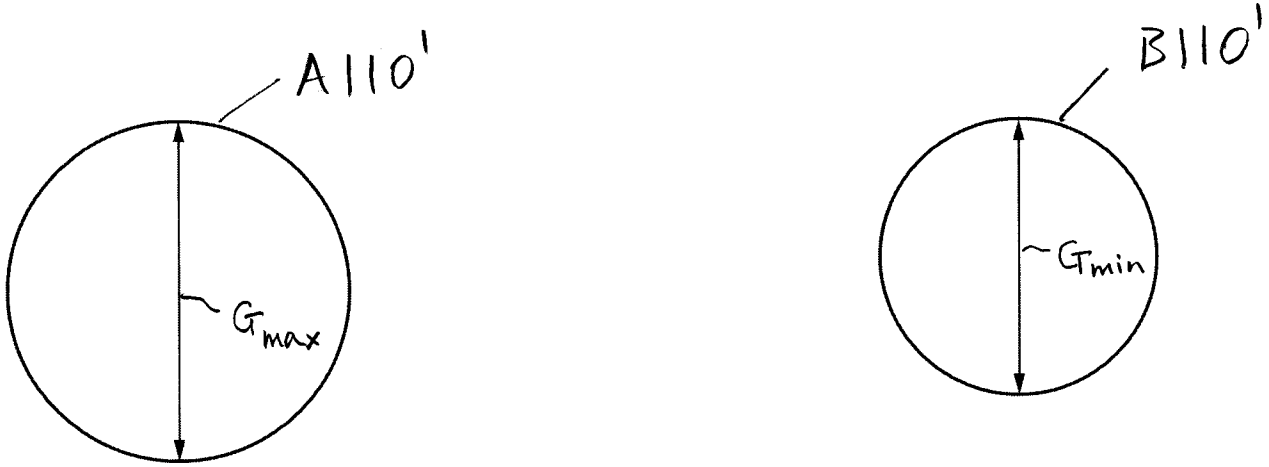
FIG. 2C is a plan view of two worn grinding balls, drawn at a larger scale.

A first worn grinding ball (identified by reference character A110' for convenience) having a diameter "$G_{max}$" is illustrated in FIGS. 2C and 4A. For clarity of illustration, the diameter "$G_{max}$" is a critical diameter that is equal to the width 162 of the aperture 154 at the second end 158. In FIG. 2C, a second worn grinding ball (identified by reference character B110' for convenience) is also illustrated, the second worn grinding ball B110' having a diameter "$G_{min}$". It will be understood that the diameter "$G_{min}$" is equal to the width 160 of the first end 156.

As noted above, the grinding balls may become worn down by comminution to various shapes, some of them irregular. Those skilled in the art would appreciate that the worn grinding balls may be ellipsoid or spheroid, in whole or in part. Many of the worn grinding balls may be substantially spherical, or at least partially spherical. The worn rock pieces also may, in practice, be at least partially ellipsoid, spheroid, or spherical, due to comminution. It will be understood that, in the drawings referred to herein, the worn grinding balls and the worn rock pieces are shown as having generally round shapes for convenience, and for clarity of illustration.

Because the discharge grate assembly 148 provides a larger aperture width 162 at the second end 158, any worn grinding ball that has been worn to a diameter that is smaller than 162 may pass through the second end 158. For example, as can be seen in FIG. 3, the worn ball B110', with a diameter "$G_{min}$", would be able to pass through the aperture 154 at the second end 158.

From the foregoing, it can be seen that, in the discharge grate assembly 148, the first end 156 is unlikely to become plugged. This is because, when the diameter of any particular worn grinding ball has a diameter less than "$G_{max}$", but before such diameter has decreased to "$G_{min}$", that particular worn grinding ball will pass through the aperture 154 at the second end 158, or at some other point in the aperture 154 where the width of the aperture 154 is greater than the particular worn grinding ball's diameter.

Those skilled in the art would appreciate that, similarly, a particular rock piece 111' with a diameter less than "$G_{max}$" will pass through the aperture 154 at the second end 158, or at another point in the aperture 154 where the width of the aperture is greater than the particular worn rock piece's diameter.

Those skilled in the art would also appreciate that the foregoing represents an analysis of an ideal situation. As a practical matter, even though it appears unlikely, any particular worn grinding ball 110' or worn rock piece 111' having a diameter greater than "$G_{min}$" but less than "$G_{max}$" may, for example, not pass through the aperture 154 (e.g., via the second end 158) due to the random nature of the movement of the worn grinding balls 110' and the worn rock pieces 111' in the mill shell chamber 134, as the mill shell 132 rotates. Also, because the worn grinding balls and the worn rock pieces may be worn into irregular shapes, they may still occasionally become lodged in the aperture 154 in practice. For example, an individual worn grinding ball may be worn so that it has a first diameter less than "$G_{max}$", and also a second diameter greater than "$G_{max}$", and due to this, that particular item may become lodged in the second end 158.

However, it is believed that, in general, the worn grinding media become lodged in the aperture 154 less frequently than when the discharge grates of the prior art are used, for the reasons set out above, and as further described below.

From the foregoing, it can be seen that forming the discharge grate body 152 so that the apertures 154 each extend between an end with a smaller width 160, and an end with a larger width 162, mitigates the risk of the worn grinding balls or worn rock pieces becoming lodged in the aperture. Although the aperture walls 164 in the discharge grate body 152 are subjected to wear over time, thereby causing the aperture's dimensions to gradually increase, it is believed that the beneficial effect of having one end of the aperture larger than the other end continues, even after the discharge grate body has been subjected to wear to a significant extent. Due to the shape of the aperture 154, the discharge grate assembly 148 has a self-cleaning aspect, as will be described.

Each of the apertures 154, which extends between the first end 156 thereof in which the width 160 of the aperture 154 is less than the aperture's average width "W", and the second end 158 thereof in which the width 162 of the aperture 154 is greater than the aperture's average width "W", represents a compromise between a larger width (i.e., larger than 162, which may tend to allow slurry with a larger particle size distribution through) and a smaller width (i.e., smaller than 160, which may tend to become plugged with worn grinding balls or worn rock pieces).

As noted above, a worn grinding ball or worn rock piece with a diameter less than "$G_{max}$" but greater than "$G_{min}$" is likely to pass through the aperture 154 at the second end 158, or at any point along the length of the aperture 154 where the width of the aperture 154 is greater than the diameter of that worn grinding ball or worn rock piece. In addition, it is believed that a worn grinding ball or worn rock piece with a diameter greater than "$G_{max}$" will not become lodged in the aperture 154, because the worn grinding ball or worn rock piece with a diameter greater than "$G_{max}$" will, when positioned in the second end 158, have its center of gravity located outwardly relative to the front side 174, i.e., the center of gravity thereof is located in the mill shell chamber 134.

FIG. 4A is intended to illustrate the movement of the worn grinding ball A110', which has a diameter of "$G_{max}$", along the aperture 154. As can be seen in FIG. 4A, when the worn grinding ball A110' is positioned at the second end 158, the center of gravity 184 thereof is aligned, or substantially aligned, with the front side 174 of the body 152 of the discharge grate assembly 148. In this situation, although part of the worn grinding ball A110' is in the aperture 154, the worn grinding ball A110' is not lodged in the aperture 154 at the second end 158, and for the purposes hereof, the center of gravity 184 of the worn grinding ball A110' is considered to be located in the mill shell chamber 134. This is because the worn grinding ball A110' with its center of gravity 184 aligned with the front side 174 may easily be removed from its position of partial insertion in the aperture 154, e.g., by the charge obliquely engaging the worn grinding ball A110', to push it off the discharge grate assembly 148 due to the rotation of the mill shell 132.

When the center of gravity 184 is not in the aperture 154, the worn grinding ball A110' is only partly in the aperture 154, and it may easily be knocked or bumped out of the aperture 154, or may simply fall out due to movement of the discharge grate assembly around the central axis 136. It is believed that the worn grinding ball A110', if it remains in contact with the body 152, may be moved along the aperture 154 (i.e., in the direction indicated by arrow "K" in FIG. 4A) to the first end 156. That is, if the worn grinding ball A110' remains engaged with the aperture walls 164, then the worn grinding ball A110' may move along the side walls 170, 172 toward the first end 156. When the worn grinding ball A110' is at the first end 156, the center of gravity 184 is further out in the mill shell chamber 134, and the worn grinding ball A110' is even more likely to fully return to the mill shell chamber 134.

Those skilled in the art would appreciate that, in one embodiment, each of the discharge grate assemblies 148 may be positioned at an angle other than 90° relative to the horizontal. For example, in FIG. 2B, the angle "Y" is approximately 105°. Accordingly, and as will be described, a worn grinding ball that engages the discharge plate body 152 at the aperture 154, and which is sufficiently large that its center of gravity 184 is not positioned in the aperture 154, may remain engaged with the aperture walls 164, at the aperture. However, when the worn grinding ball A110' is located at the first end 156, its center of gravity 184 is positioned relatively far into the mill shell chamber 134, and the worn grinding ball A110' at this location therefore is relatively easily knocked or bumped off the aperture, into the mill shell chamber 134.

From FIGS. 3 and 4A, it can be seen that the center of gravity 184 of the worn grinding ball that remains engaged with the side walls 170, 172 while moving along the aperture 154 from the second end 156 to the first end 154 will gradually be moved further into the mill shell chamber 134. This is the "self-cleaning" action referred to above.

In the example illustrated in FIG. 4A, the center of gravity 184 of the worn ball A110' that is located at the second end 158 is substantially aligned with the front side 174 of the body 152 of the discharge grate assembly 148, and in any event, the center of gravity 184 is not located in the aperture 154. However, as the worn grinding ball A110' moves in the direction indicated by arrow "K" in FIG. 4A, because the aperture 154 gradually narrows from the second end 158 to the first end 156, the center of gravity 184 is gradually moved further away from the front side 174, i.e., toward and into the mill shell chamber 134. Such outward direction of movement (into the mill shell chamber) of the center of gravity 184 is indicated by arrow "M" in FIG. 4A. The worn grinding ball A110' may be pushed along the aperture walls 164 due to the rotation of the mill shell and the corresponding movement of the discharge grate assembly, or by the elements of the charge that are moving in the mill shell chamber and engaging (bumping against) the discharge grate assemblies and any objects located thereon, as the mill shell is rotated.

With the worn grinding ball A110' located at the first end 156, and based on certain assumptions (set out below), it is possible to determine, in one embodiment, what the ideal "$G_{min}$" (i.e., the first end width 160) may be, relative to a given "$G_{max}$" (i.e., the second end width 162).

In the example illustrated in FIG. 4A, the center of gravity 184 of the worn grinding ball A110' is located at a distance above the front side 174 of the body 152 that is 0.25 of the diameter of the worn ball A110', i.e., 0.25 of "$G_{max}$". In FIG. 4A, in order to determine the relationship between "$G_{max}$" and "$G_{min}$", an imaginary right triangle is illustrated. The hypotenuse of that right triangle is 0.5"$G_{max}$". Using the Pythagorean theorem, it can be determined that, ideally:

$$\text{“}G_{min}\text{”}=(3^{0.5}/2)\text{“}G_{max}\text{”}$$

Accordingly, it is believed that the discharge grate assembly 148 is generally self-cleaning, as described above, when the relationship between "$G_{max}$" and "$G_{min}$" (i.e., the second end width 162 and the first end width 160, respectively) is as set out above. Those skilled in the art would appreciate that the foregoing determination is based on the proportions that are believed to be relevant, and which are shown in FIG. 4A. For example, if the position of the center of gravity 184 of the worn grinding ball A110' is not 0.25"$G_{max}$" outwardly from the front side 174 when the worn grinding ball A110' is located at the first end 156, then the relationship between "$G_{max}$" and "$G_{min}$" would be different.

Those skilled in the art would also appreciate that the aperture 154 may have any suitable length "L". As noted above, the aperture 154 is elongate. In one embodiment, for example, it is believed that "L" may be equal to 3"$G_{max}$".

It will also be understood that the discharge grate body 152, 252 may be made of any suitable material, or materials. For example, the body 152, 252 may be made of a suitable steel, or a suitable rubber or other polymer. Alternatively, the body 152, 252 may include any combination thereof, e.g., steel and rubber. As additional examples, the body 152, 252 may be made of suitable ceramics, or suitable composite materials.

Although the discharge grate assembly 148 has been described mounted in a grinding mill, those skilled in the art would appreciate that the discharge grate assembly 148 may be used in other applications, e.g., in a screening facility. For example, the discharge grate assembly 148 may be used in a cement plant. The discharge grate assembly 148 may be used in any situation where the output of a comminution process (wet or dry) includes pieces or particles that are to be screened, to limit the portion of the output that passes to a particular particle size distribution that is less than a specified size.

From the foregoing, it can be seen that the differences between the embodiment of the discharge grate assembly 148 illustrated in FIG. 5 and the embodiment of the discharge grate assembly 248 illustrated in FIGS. 6A-6D are that the end walls 166, 168 in the discharge grate assembly 148 are rounded (i.e., defined by arcs of circles of differing radii), and the end walls 266, 268 in the discharge grate assembly 248 are at least partially straight, or rectilinear. Those skilled in the art would appreciate that the discharge grate assembly 248 is self-cleaning at least to the same extent as the discharge grate assembly 148, because the first and second ends of the aperture 254 have different widths. Accordingly, for the discharge grate assembly 248, as with the discharge grate assembly 148, the ideal relationship between "$G_{max}$" and "$G_{min}$" is as follows:

$$\text{“}G_{min}\text{”}=(3^{0.5}/2)\text{“}G_{max}\text{”}$$

For exemplary purposes, a worn grinding ball A210' having a diameter "$G_{max}$" and a second worn grinding ball B210' having a diameter "$G_{min}$" are illustrated in FIG. 6A. Those skilled in the art would also appreciate that the aperture 254 may have any suitable length "2L" (FIG. 6A). As noted above, the aperture 254 is elongate. In one embodiment, for example, it is believed that "2L" may be equal to 3"$G_{max}$".

It is believed that, because the first and second end walls 266, 268 are at least partially rectilinear, they impede worn grinding balls 110' or worn rock pieces 111' that might otherwise fall into, or be received into, the aperture 254 from lodging therein. For the purposes hereof, a worn grinding ball or a worn rock piece is considered to be received or lodged in the aperture 254 if the center of gravity thereof is between a plane "Z" defined by the front side 274, and the pulp chamber 150 (FIG. 4B).

Figure 6C:
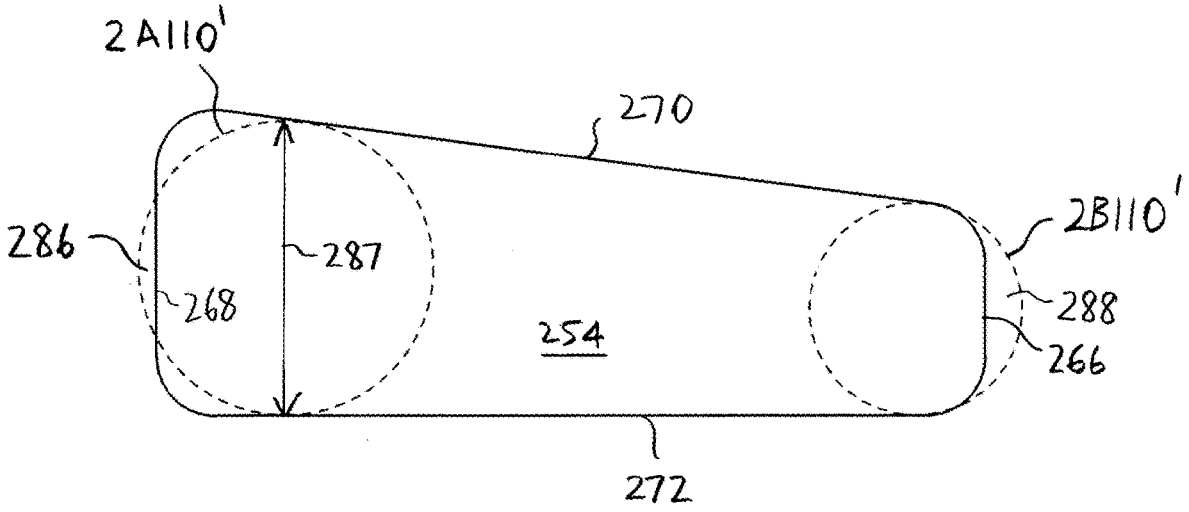
FIG. 6C is a portion of the discharge grate assembly of FIG. 6B, drawn at a larger scale.

In FIG. 6C, a worn grinding ball 2A110' is illustrated that is located at the second end 258 of the aperture 254, and a smaller worn grinding ball 2B1110' is located at the first end 256. As can be seen in FIG. 6C, although the worn grinding ball 2A110' is substantially aligned with the side walls 270, 272, a portion 286 of the worn grinding ball 2A110' overlaps the second end wall 268, so that the second end wall 268 impedes the worn grinding ball 2A110' from lodging in the aperture 254 at the second end 258. The portion 286 overlaps the end wall 268 because the worn grinding ball 2A110' is at least partially rounded, e.g., spherical, ellipsoid, or spheroid, in whole or in part, and the end wall is at least partially rectilinear.

A side view of the worn grinding ball 2A110' at the second end 258 is also provided in FIG. 4B. As can be seen in FIG. 4B, due to the rectilinear end wall 268, the center of gravity 184 of the worn grinding ball 2A110' is thereby located in the mill shell chamber 134. The center of gravity 184 of the worn grinding ball 2A110' is located a distance "E" from the front side 274, in the mill shell chamber 134 (FIG. 4B).

As can be seen in FIG. 6C, the worn grinding ball 2A110' has a diameter 287 that is approximately equal to the width of the aperture 254, at the second end 258. However, because the second end wall 268 is rectilinear, the second end wall 268 impedes the worn grinding ball 2A110' from lodging in the aperture 254.

In the same way, a portion 288 of the worn grinding ball 26110' overlaps the first end wall 266. Because of this overlap, the worn grinding ball 26110' is impeded from lodging in the aperture 254 at the first end 256, even though the worn grinding ball 26110' has a diameter 289 that is approximately equal to the width of the aperture 254 at the first end 256. In this case, because the first end wall 266 is rectilinear, the worn grinding ball 26110' is impeded thereby from lodging in the aperture 254. Although the aperture walls 264 are worn down over time because of the wear to which they are subjected, it is believed that the end walls 266, 268 and the side walls 170, 172 remain generally rectilinear, even after they are subjected to significant wear over time.

A side view of the worn grinding ball 26110' at the first end 256 is also provided in FIG. 4B. As can be seen in FIG.

4B, due to the rectilinear end wall 256, the center of gravity 184 of the worn grinding ball 26110' is thereby located in the mill shell chamber 134. The center of gravity 184 of the worn grinding ball 26110' is located a distance "F" from the front side 274, in the mill shell chamber 134 (FIG. 4B).

Because the second end 258 is wider than the first end 256, the side walls 270, 272 are not parallel. Due to the aperture 254 gradually narrowing from the second end 258 to the first end 256, the discharge grate assembly 248 is self-cleaning, as is the other embodiment of the discharge grate assembly 148. From the foregoing, it can be seen that the discharge grate assembly 248 is both self-cleaning and also has rectilinear end walls 266, 268 that impede worn grinding balls and worn rock pieces from lodging in the aperture 254.

It is preferred that the aperture wall edges 276 of each of the aperture walls defining the second end 258 engage the worn grinding balls and the rock pieces having diameters equal to or larger than the second end width 262 to locate the centers of gravity 184 of the worn grinding balls and the rock pieces having diameters equal to or larger than the second end width in the mill shell chamber 134, to impede lodging thereof in the respective apertures 254 (FIG. 4B).

It is also preferred that the aperture wall edges 276 of the aperture walls 264 defining the first end 256 engage the worn grinding balls and the rock pieces having diameters equal to or larger than the first end width 260 to locate the centers of gravity 184 of the worn grinding balls and the rock pieces in the mill shell chamber 134, to impede lodging thereof in the first end 256 of the apertures 254 (FIG. 4B).

As can be seen in FIG. 6B, the aperture 254 is partially defined by a center line 290 thereof extending between a first middle point "$P_1$" of the first end wall 256 and a second middle point "$P_2$" of the second end wall 258. The body 252 preferably is elongate, and extends between inner and outer ends 292, 294 thereof. Those skilled in the art would appreciate that, when the discharge grate assembly 248 is mounted in the discharge end wall system 146, the inner end 292 is located proximal to the central axis of the mill shell, and the outer end being located distal to the central axis.

As can be seen in FIG. 6B, the apertures 254 preferably are located in the body 252 spaced apart from each other, so that the center lines 290 of the apertures 254 are located at least partially transverse to a middle line 295 extending between the inner and outer ends 292, 294 of the body 252. Preferably, the apertures 254 are located spaced apart from each other in the body 252 with the center lines 290 of the apertures 254 being located orthogonal to the middle line 295 of the body 252.

From the foregoing, it can be seen that the body 252 of the discharge grate assembly 248 has a front side 274 facing the mill shell chamber 134 and an opposite rear side 298. The rear side 298 of the body 252 faces the pulp chamber 150 to which the discharge grate body 252 is adjacent. As noted above, the body 252 includes a number of the apertures 254 for permitting the worn grinding balls and the worn rock pieces that have a predetermined maximum permitted size sufficiently small to pass through the apertures into the pulp chamber.

The first end 256 preferably is defined by the first end wall 266, which is at least partially rectilinear, and the second end 258 of the aperture 254 preferably is defined by the second wall 268, which also is at least partially rectilinear. As noted above, the second end width 262 is greater than the first end width 262. The first and second end walls 266, 268 are formed to impede the worn grinding balls and the worn rock pieces that are larger than the predetermined maximum permitted size from being lodged in the aperture 254.

Those skilled in the art would appreciate that the discharge end wall system 146 preferably includes a number of pulp lifters 301 radially arranged on the discharge end wall 138 relative to the central axis 136. The pulp lifters 301 are located for partially defining the pulp chambers 150.

The bodies 252 of the discharge grate assemblies 248 are located between the mill shell chamber 134 and the respective pulp chambers 150. As can be seen in FIG. 6B, the apertures 254 in the bodies 252 are defined by aperture walls formed in the body, the aperture walls comprising first and second end walls and first and second side walls extending between the respective first and second end walls 266, 268. The aperture 254 is partially defined by the center line 290 thereof, extending between the first and second ends 256, 258 at midpoints thereof (FIG. 6A). Preferably, and as described above, the first and second end walls 266, 268 are at least partially rectilinear, and located substantially orthogonal to the center line 290 of the aperture 254.

Figure 6D:
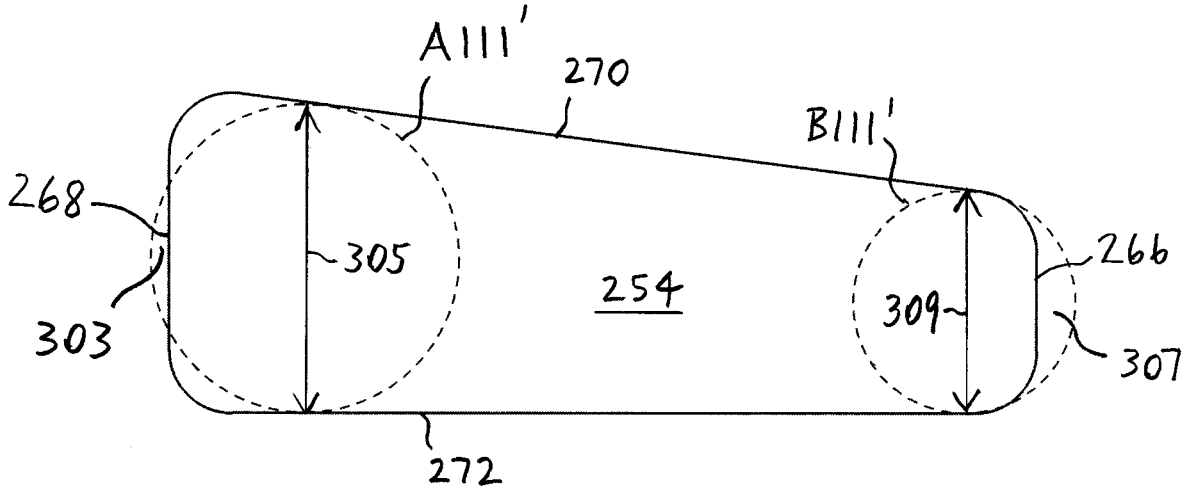
FIG. 6D is a portion of the discharge grate assembly of FIG. 6B, drawn at a larger scale.

In FIG. 6D, a worn rock piece A111' is illustrated that is located at the second end 258 of the aperture 254, and a smaller worn rock piece B111' is located at the first end 256. As can be seen in FIG. 6D, although the worn rock piece A111' is substantially aligned with the side walls 270, 272, a portion 303 of the worn rock piece A111' overlaps the second end wall 268, so that the second end wall 268 impedes the worn rock piece A111' from lodging in the aperture 254 at the second end 258. The portion 303 overlaps the end wall 268 because the worn rock piece A111' is at least partially rounded, e.g., spherical, ellipsoid, or spheroid, in whole or in part, and the end wall 268 is at least partially rectilinear.

As can be seen in FIG. 6D, the worn rock piece A111' has a diameter 305 that is approximately equal to the width of the aperture 254, at the second end 258. However, because the second end wall 268 is rectilinear, the second end wall 268 impedes the worn rock piece A111' from lodging in the aperture 254. It will be understood that the center of gravity of the worn rock piece A111' is located in the mill shell chamber 134.

In the same way, a portion 307 of the worn rock piece B111' overlaps the first end wall 266. The portion 307 overlaps the first end wall 266 because the worn rock piece B111' is at least partially rounded. Because of this overlap, the worn rock piece B111' is impeded from lodging in the aperture 254 at the first end 256, even though the worn rock piece B111' has a diameter 309 that is approximately equal to the width of the aperture 254 at the first end 256. In this case, because the first end wall 266 is rectilinear, the worn rock piece B111' is impeded thereby from lodging in the aperture 254. It will be understood that the center of gravity of the worn rock piece B111' is located in the mill shell chamber 134.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A grinding mill, comprising:

a shell defining a mill shell chamber therein in which a charge including grinding balls and ore-bearing rocks is positioned, the shell being rotatable in a predetermined direction about a central axis thereof for comminution of the ore-bearing rocks to produce a mixture including a fluid and worn rock pieces from the ore-bearing rocks, wherein the commnution of the ore-bearing rocks forms the grinding balls into worn grinding balls;

a discharge end wall attached to the shell, the discharge end wall extending between an outer edge thereof connected to the shell and an inner edge thereof at least partially defining a central opening in the discharge end wall; and a discharge end wall system, comprising:

a plurality of discharge grate assemblies; and a plurality of pulp chambers located between the respective discharge grate assemblies and the discharge end wall, for directing the mixture received therein toward the central opening, to exit the grinding mill therethrough, wherein each said discharge grate assembly is positioned to screen the mixture flowing from the mill shell chamber into each said pulp chamber respectively as the shell rotates about the central axis, wherein each said discharge grate assembly is rotatable with the shell about the central axis between a lowered condition, in which the mixture is flowable through at least part of each said discharge grate assembly into the pulp chamber adjacent thereto respectively, and a raised condition, in which the discharge grate assembly is positioned above the charge, and wherein each said discharge grate assembly comprises:

a body comprising a plurality of elongate apertures therein, formed to screen the mixture flowing therethrough from the mill shell chamber into the pulp chamber, wherein each said aperture extends between respective first and second ends thereof, the first end having a predetermined first end width and the second end of the aperture having a predetermined second end width that is larger than the first end width, wherein each said aperture is defined by aperture walls formed in the body; and wherein the aperture walls comprise first and second end walls that are at least partially rectilinear and partially define the first and second ends respectively, the first and second end walls being formed to impede the worn grinding balls and the worn rock pieces in the mixture from lodging in the aperture.

2. The grinding mill according to claim 1, wherein the aperture walls additionally comprise first and second side walls respectively extending between the first end wall and the second end wall.

3. The grinding mill according to claim 2, wherein the first and second side walls are at least partially rectilinear.

4. The grinding mill according to claim 3, wherein:

the body comprises an at least partially planar front side facing the mill shell chamber; and each of the aperture walls defines an aperture wall edge thereof at which each said aperture wall intersects the front side of the body.

5. The grinding mill according to claim 4, wherein the aperture wall edges of each said aperture wall defining the second end engage the worn grinding balls and the rock pieces having diameters larger than the second end width to locate the centers of gravity of the worn grinding balls and the rock pieces having diameters larger than the second end in the mill shell chamber width, to impede lodging thereof in each said aperture respectively.

6. The grinding mill according to claim 5, wherein the aperture wall edges of each said aperture wall defining the first end engage the worn grinding balls and the rock pieces having diameters larger than the first end width to locate the centers of gravity of the worn grinding balls and the rock pieces having diameters larger than the first end width in the mill shell chamber, to impede lodging thereof in each said aperture respectively.

7. The grinding mill according to claim 3, wherein each said aperture is partially defined by a center line thereof extending between a first middle point of the first end wall and a second middle point of the second end wall.

8. The grinding mill according to claim 7, wherein the body of each said discharge grate assembly is elongate and extends between inner and outer ends thereof, the inner end being located proximal to the central axis of the mill shell, and the outer end being located distal to the central axis.

9. The grinding mill according to claim 8, wherein the center lines of the apertures are located at least partially transverse to a middle line of the body extending between the inner and outer ends thereof.

10. The grinding mill according to claim 9, wherein the apertures are located spaced apart from each other in the body with the center lines of the apertures being located orthogonal to the middle line of the body.

11. A discharge grate assembly in a discharge end wall system in a mill shell of a grinding mill, the mill shell defining a mill shell chamber therein in which a charge including grinding balls and rocks is positioned, the mill shell being rotatable about a central axis thereof for comminution of the rocks to produce a mixture including a fluid and worn rock pieces from the rocks, wherein the comminution of the rocks forms the grinding balls into worn grinding balls, the discharge grate assembly comprising:

a body having a front side facing the mill shell chamber and an opposite rear side, the body comprising a plurality of apertures for permitting the fluid and the rock pieces having a predetermined maximum permitted size sufficiently small to pass through the apertures into a pulp chamber located adjacent to the rear side of the body, wherein each said aperture is defined by aperture walls formed in the body, each said aperture extending between first and second ends thereof, the first end being defined by a first rectilinear wall having a predetermined first end width and the second end of the aperture being defined by a second rectilinear wall having a predetermined second end width that is greater than the first end width, to impede the worn grinding balls and the worn rock pieces from being lodged in the aperture.

12. The discharge grate assembly according to claim 11, wherein the aperture walls additionally comprise first and second side walls extending between the first and second end walls, the first and second side walls being rectilinear.

13. The discharge grate assembly according to claim 12, wherein:

the body comprises a planar front side facing the mill shell chamber;

each of the aperture walls defines an aperture wall edge thereof at which each said aperture wall intersects the front side of the body; and the aperture wall edges of each said aperture wall defines the second end engage the worn grinding balls and the rock pieces having diameters larger than the predetermined maximum permitted size to locate the centers of gravity thereof in the mill shell chamber, to impede lodging thereof in each said aperture respectively.

14. A discharge end wall system mounted on a discharge end wall of a mill shell in a grinding mill, the mill shell defining a mill shell chamber therein in which a charge including rocks and grinding balls is positioned, the mill shell being rotatable about a central axis thereof for comminution of the rocks to produce a mixture including a fluid and worn rock pieces, wherein the comminution of the rocks forms the grinding balls into worn grinding balls, the discharge end wall system comprising:

a plurality of pulp lifters radially arranged on the discharge end wall relative to the central axis, the pulp lifters being located to partially define pulp chambers; and a plurality of discharge grate assemblies positioned between the pulp chambers and the mill shell chamber, for screening the mixture moving into the pulp chambers from the mill shell chamber, wherein each said discharge grate assembly comprises a body with a plurality of elongate apertures therein for screening the mixture, wherein each said elongate aperture is defined by aperture walls formed in the body, the aperture walls comprising first and second end walls and first and second side walls extending between the respective first and second end walls, wherein each said aperture is defined by a center line thereof intersecting each of the first and second ends at midpoints thereof, and wherein the first and second end walls are rectilinear and located orthogonal to the center line of the aperture.

15. The discharge end wall system according to claim 14, wherein:

the first end wall and the first and second side walls of each said aperture define a first end of the aperture formed to permit the worn grinding balls and the rock pieces having a predetermined first end permitted size to pass therethrough; and the second end wall and the first and second side wall define a second end of the aperture that is larger than the first end, to permit the worn grinding balls and the rock pieces having a predetermined second end permitted size therethrough.

16. The discharge end wall system according to claim 15, wherein the body of each said discharge grate assembly extends between an inner end that is located proximal to the central axis and an outer end located proximal to the outer perimeter, and the body is partially defined by a center body line thereof dividing the body into two equal parts.

17. The discharge end wall system according to claim 16, which, wherein the apertures are formed in the body such that the respective center lines thereof are located transverse relative to the center body line.

18. The discharge end wall system according to claim 17, wherein:

the body comprises an at least partially planar front side facing the mill shell chamber; and each of the aperture walls defines an aperture wall edge thereof at which each said aperture wall intersects the front side of the body.

19. The discharge end wall system according to claim 18, wherein the aperture wall edges of said aperture walls defining the second end engage the worn grinding balls and the rock pieces having diameters larger than the predetermined second end permitted size to locate the centers of gravity thereof in the mill shell chamber, to impede lodging thereof in said aperture.

20. The discharge end wall system according to claim 18, wherein the aperture wall edges of said aperture walls defining the first end engage the worn grinding balls and the rock pieces having diameters larger than the predetermined first end size to locate the centers of gravity thereof in the mill shell chamber, to impede lodging thereof in said aperture.

21. A discharge grate assembly in a discharge end wall system in a mill shell of a grinding mill, the mill shell defining a mill shell chamber therein in which a charge including rocks is positioned, the mill shell being rotatable about a central axis thereof for comminution of the rocks to form the rocks into worn rock pieces and to produce a mixture including a fluid and the worn rock pieces, the discharge grate assembly comprising:

a body having a front side facing the mill shell chamber and an opposite rear side, the body comprising a plurality of apertures for permitting the fluid and the rock pieces having a predetermined maximum permitted size sufficiently small to pass through the apertures into a pulp chamber located adjacent to the rear side of the body, wherein each said aperture is defined by aperture walls formed in the body, each said aperture extending between first and second ends thereof, the first end being defined by a first rectilinear wall having a predetermined first end width and the second end of the aperture being defined by a second rectilinear wall having a predetermined second end width that is greater than the first end width, to impede the worn rock pieces that are larger than the predetermined maximum permitted size from being lodged in the aperture.

22. The discharge grate assembly according to claim 21, wherein:

the body comprises an at least partially planar front side facing the mill shell chamber;

each of the aperture walls defines an aperture wall edge thereof at which each said aperture wall intersects the front side of the body; and the aperture wall edges of each said aperture wall define the second end engage the rock pieces having diameters larger than the predetermined maximum permitted size to locate the centers of gravity thereof in the mill shell chamber, to impede lodging thereof in each said aperture respectively.

* * * * *